US005727269A

United States Patent [19]

Chung

[11] Patent Number: 5,727,269

[45] Date of Patent: Mar. 17, 1998

[54] WATER BED WITH INTERNAL AIR BAG(S)

[76] Inventor: Ming-Chun Chung, 7F, No. 22, Alley 3, Lane 227, Nung An Street, Taipei, Taiwan

[21] Appl. No.: 845,083

[22] Filed: Apr. 21, 1997

[51] Int. Cl.[6] ..... A47C 27/10

[52] U.S. Cl. ..... 5/680; 5/681; 5/682; 5/685

[58] Field of Search ..... 5/680, 678, 681, 5/682, 685, 687, 665, 422

[56] References Cited

U.S. PATENT DOCUMENTS

| | | | |
|---|---|---|---|
| 4,015,299 | 4/1977 | Tinnel | 5/680 |
| 4,168,555 | 9/1979 | Benjamin | 5/682 |
| 4,187,566 | 2/1980 | Peterson | 5/680 |
| 4,310,936 | 1/1982 | Benjamin | 5/687 |
| 4,558,476 | 12/1985 | Linder | 5/682 |
| 4,597,120 | 7/1986 | Fogel et al. | 5/685 |
| 4,638,518 | 1/1987 | Barbulla | 5/687 |
| 4,901,386 | 2/1990 | Lane | 5/687 |
| 4,912,789 | 4/1990 | Maxwell | 5/680 |
| 5,507,048 | 4/1996 | Hauser et al. | 5/685 |

*Primary Examiner*—Alexander Grosz

*Attorney, Agent, or Firm*—Beveridge, DeGrandi, Weilacher & Young, L.L.P.

[57] ABSTRACT

A water bed in accordance with the present invention comprises a water bed base and a plurality of water bed mattresses. The water bed base defines a number of container chambers into which an equivalent number of water bed mattresses are respectively removably inserted. Each container chamber is sealed and thus advantageously prevents any of the water bed mattresses which may be leaking water from leaking water outside of the water bed base. Further, the leaking water bed mattress, because it is removably inserted into the water bed base, may be individually replaced. Also, the water bed mattress has a plurality of air and water chambers, some having fluid baffles to restrict the free flow of fluids. Further, the water bed base has several air chambers. These chambers maintain the shape of the water bed while providing a regulator and an absorbing means of the pressure inside the water bed. Thus, user comfort is maximized.

19 Claims, 9 Drawing Sheets

WATER BED WITH INTERNAL AIR BAG(S)

BACKGROUND OF THE INVENTION

Most water beds currently on the market today are manufactured as a single integrated unit. When this type of water bed leaks, as from a tear in the mattress, the entire bed must be replaced, as usually tears of this nature can not be repaired.

Additionally, most conventional single unit water bed mattresses are divided into a plurality of elongated water chambers. When pressure is applied from the outside, such as by a user laying thereon, the mattress is subjected to direct water pounding which causes waves in the bed which uncomfortably and uncontrollably sway the user. Also, the applied pressure could possibly separate the seams of the waterbed, causing water to leak from the bed.

Because of these drawbacks, conventional water beds typically experience high degrees of instability and also are suceptiple to leakage.

Therefore, an object of the present invention is to provide an improved water bed structure which can absorb or reduce internal pressure and wave energy.

Another object of the present invention is to provide a water bed structure which has long term durability, can be efficiently manufactured and is inexpensively repaired.

Yet another object of the present invention is to provide a new and improved water bed structure, wherein a water bed mattress is removably contained within a water bed base and thus, the mattresses can be individually replaced when it is damaged and/or it leaks.

Still another object of the present invention is to provide an improved water bed structure having a water bed mattress which can effectively disperse lateral motion, thereby remaining springy but stable, to increase the comfort level of a user.

It is still a further object of the present invention to provide a water bed structure which has an exterior seal to provide an aesthetic outer appearance while functionally preventing water from contacting the electrical supply lines of a heating element located outside of the exterior seal.

It is yet still a further object of the present invention to provide a water bed having a single water bed base and a plurality of water bed mattresses so that only a single mattress unit need be replaced if it becomes damaged and/or it leaks, thereby preventing replacement of the entire water bed.

SUMMARY OF THE INVENTION

The present invention relates to a water bed structure having a plurality of mattresses which are used in combination with a water bed base. More particularly, the present invention relates to a water bed structure in which each of a plurality of mattresses have pressure reducing means to prevent internal fluid waves and which also can be individually replaced when damaged.

A water bed structure in accordance with the present invention generally comprises a plurality of water bed mattresses, a water bed base, and a heater. The water bed of the present invention has an aesthetic outer appearance, is highly comfortable, and has a high degree of stability. Further, the firmness of the bed is freely adjustable. The water bed mattress and base advantageously may be manufactured separately and independently and then assembled as needed. The water bed structure of the present invention allows the water bed mattress to be independently replaced as the water bed mattress and the water bed base are separate units.

Further, a heater of this water bed structure is preferably located under the water bed base and thus does not directly contact either mattress unit. Therefore, any water leaking from the mattress is contained inside the mattress compartment of the water bed base and thus water is effectively prevented from coming into contact with electrical current.

Therefore, a water bed structure in accordance with one aspect of the present invention comprises a water bed mattress having an interior chamber divided into a plurality of transverse water chambers by a plurality of buffering partition boards. Each of the buffering partition boards also have a plurality of locating holes defined therein. Received in each of the locating holes defined in the buffering partition boards is a plurality of air bags. A plurality of sealing partition boards also are disposed the interior chamber of the mattress and one of the sealing partition boards and an end of the internal chamber of the mattress form a border air chamber. A plurality of inflatable partition boards also are disposed in the internal chamber of the mattress and each has a plurality of inflation holes defined therein. One of the inflatable partition boards and one of the sealing partition boards form an inflation chamber. Each of the air bags are in fluid communication with the inflation chamber via the inflation holes. The border air chamber has a plurality of partition boards disposed therein, each having a ventilation hole, which further define the border air chamber into a plurality of independent border air chambers.

The water bed base of this water bed structure includes a bottom external cover, a side cover, and a top external cover having a plurality of container holes defined therein. Three flexible positioning strips are positioned to define at least a part of two container chambers, each of which has an interior volume slightly larger than said mattress. In the flexible positioning strips are a plurality of positioning partition boards each having a ventilation hole defined therein. Further, a plurality of releasably secured cover members are positioned on an upper surface of said top external cover, one end of each being fixed to the top external cover and another end of each being releasably secured to the lop external cover such that each of the cover members removably cover each container hole.

BRIEF DESCRIPTION OF THE DRAWINGS

The objects and advantages of the present invention will become even more apparent from the following detailed description of drawings; in which.

DETAILED DESCRIPTION OF THE DRAWINGS

Figure 1:
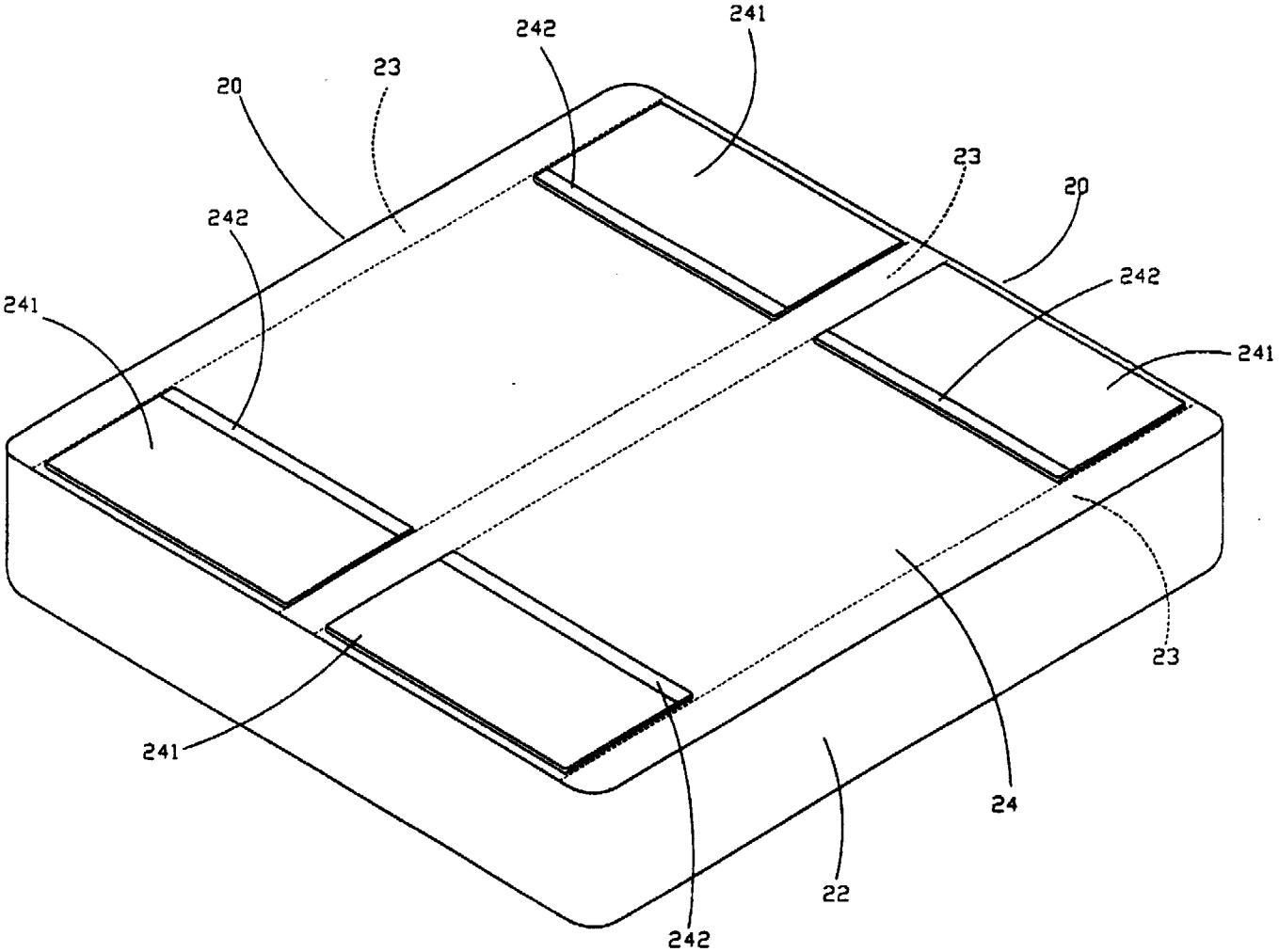
FIG. 1 is a perspective view of the exterior of the water bed structure according to a preferred embodiment of the present invention.
Figure 2:
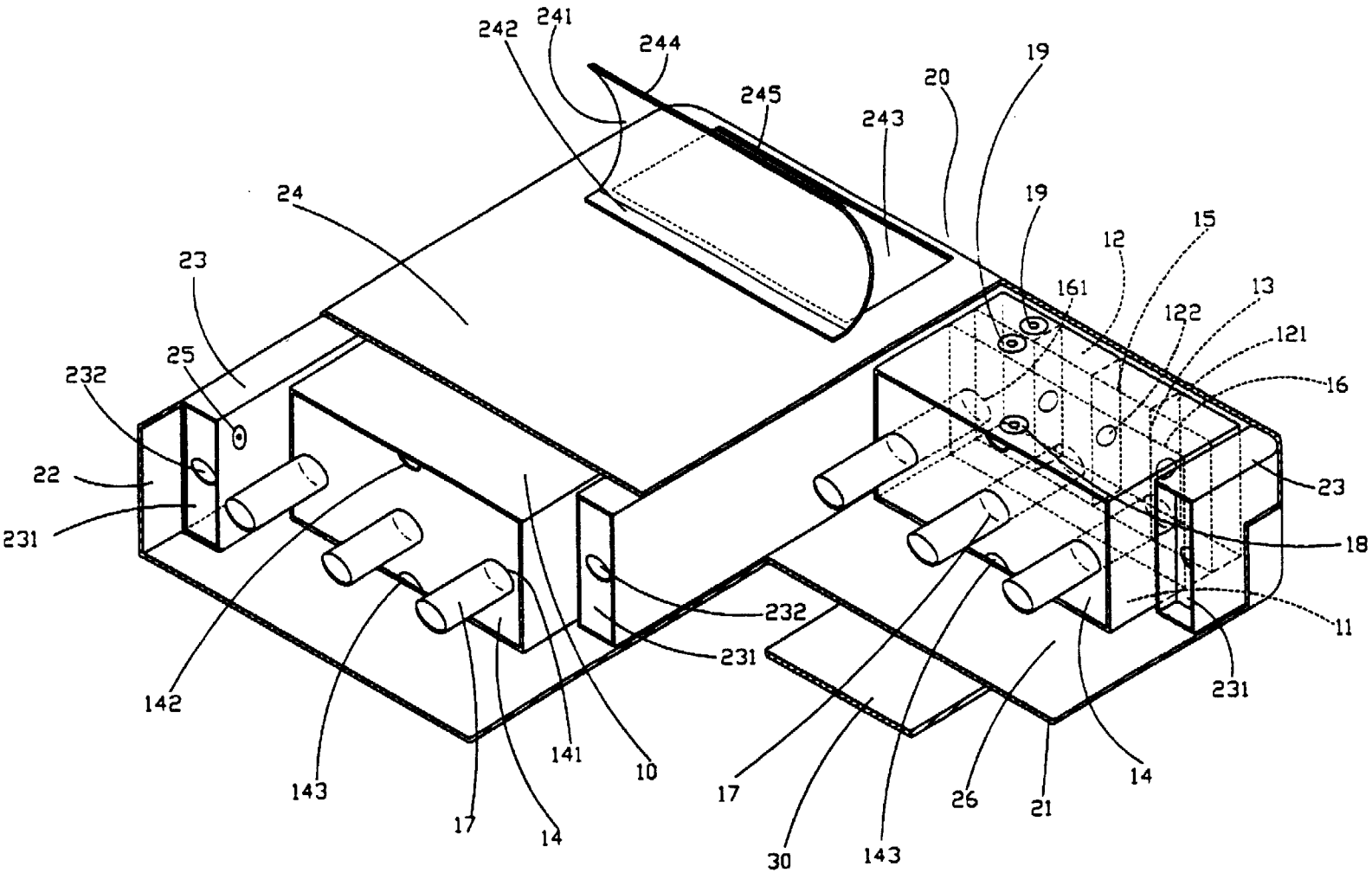
FIG. 2 is a partial cross-section view of the water bed structure shown in FIG. 1.

Referring to FIGS. 1–5, a preferred embodiment of the water bed structure according to the present invention generally comprises two water bed mattresses 10, a water bed base 20, and two heaters 30 (only one such heater 30 is shown in FIG. 2).

The water bed mattresses 10 and base 20 can be made from any suitable water bed material conventionally known in the industry. Further, all of the connecting joints of the water bed mattress 10 and the water bed base 20 are sealed preferably with a high frequency heat sealing apparatus, although any suitable form of sealing technique known to those skilled in the art may be satisfactorily used. Also, the two equally sized rectangular water bed mattresses 10 illustrated in FIG. 2 are shown for exemplary purposes only, one of ordinary skill in the art readily appreciating that a variety of mattress multiplicities, shapes and sizes also may be used in accordance with the features of this invention to accommodate different needs of many consumers.

A plurality of buffering partition boards 14 are attached to the interior of the water bed mattresses 10 and divide the interior into a plurality of transverse water chambers 11. A plurality of locating holes 141 are defined in each of the buffering partitioning boards 14 and each receive an elongated air bag 17. Six air bags 17 are shown in FIG. 2, three in each mattress 10, with each preferably passing through one of the locating holes 141 defined through each of the buffering partitioning boards 14. Preferably, the locating holes 141 of each buffering partitioning boards 14 are linearly aligned. An exhaust hole 142 and a water-connecting hole 143 preferably also are defined through each buffering partition board 14. Preferably, the exhaust hole 142 and the water connecting hole 143 are located at the top and the bottom portions of the buffering partition boards 14, respectively.

A sealing partition board 15 is disposed at each end of each water bed mattress 10. Each sealing partition board 15 has four exterior edges joined with the interior of the water bed mattress 10. Each sealing partition boards 15 combined with the external covering of the water bed mattress 10 form, at each end of the bed, a border air chamber 12. A plurality of vertical partition boards 121, each having a ventilation hole 122 defined therethrough, are attached to the interior sides of the border air chambers 12 and further define the border air chambers 12 into pluralities of independent border air chambers. The ventilation holes 122 allow for fluid communication between each of the independent border air chambers but also are sized small enough to provide resistance from the border air chamber 12 being overinflated and/or deformed.

Figure 5:
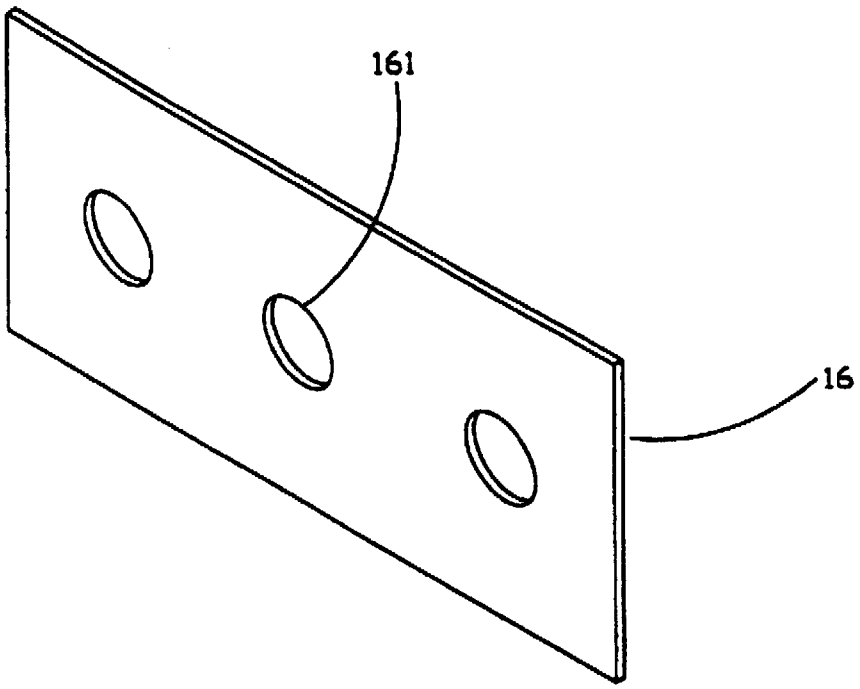
FIG. 5 is a perspective external view of an inflatable partition board shown in the water bed mattress of FIG. 3.

A plurality of inflation chambers 13 are respectively defined by the sealing partition boards 15 and a plurality of inflatable partition boards 16. Each inflatable partition board 16 has a plurality of inflation holes 161 defined therethrough which respectively receive an end of each of the air bags 17. The inflation chambers 13 are in fluid communication with the air bags 17 via the inflation holes 161. The inflatable partition boards 16, which are most clearly illustrated in FIG. 5, are similar to the buffering partition boards 14, which are most clearly illustrated in FIG. 4, except that the inflatable partition boards 16 do not have water connecting or air exhaust holes.

Figure 6:
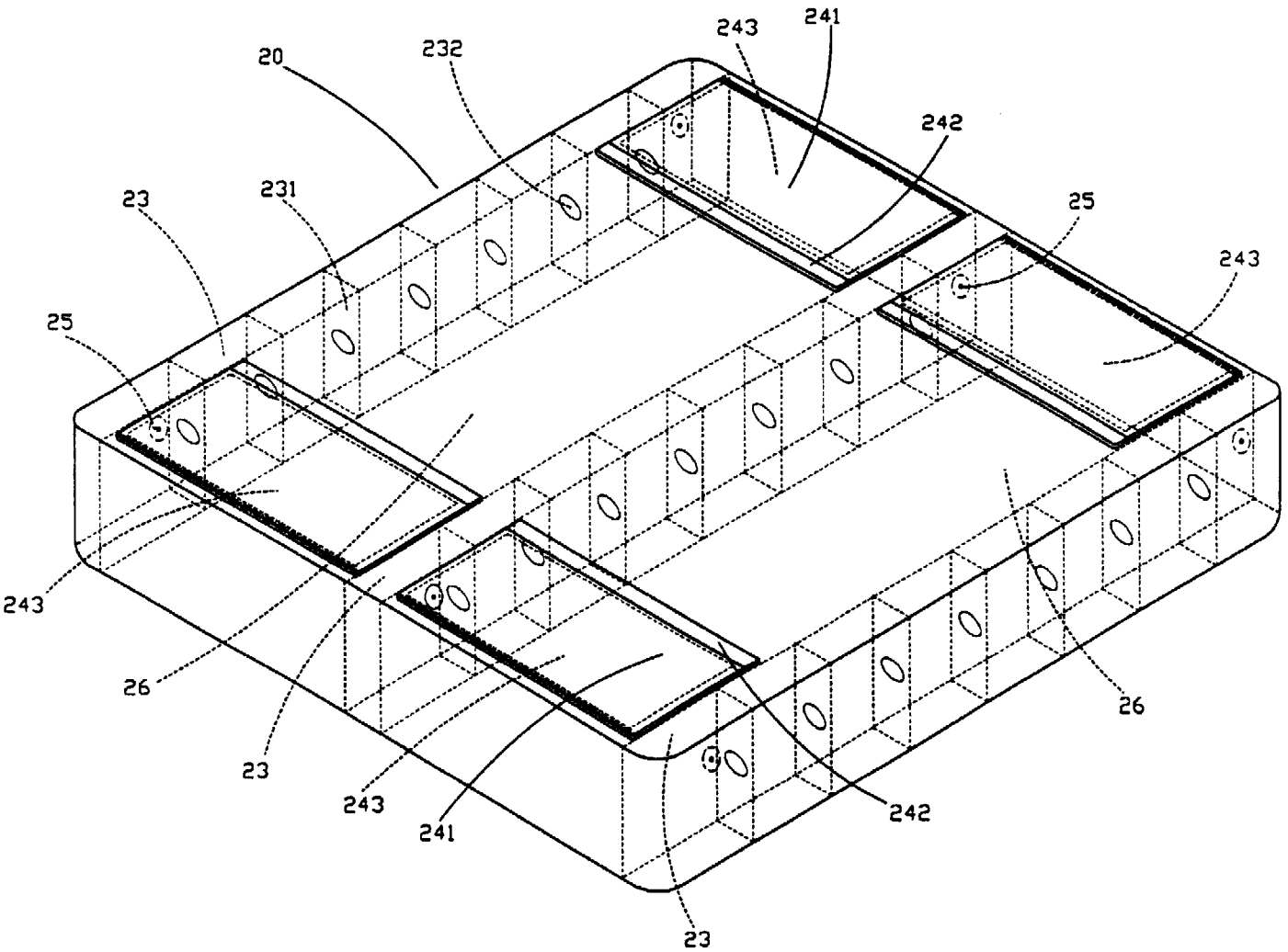
FIG. 6 is a perspective view of a water bed base for use with the water bed structure shown in FIGS. 1 and 2.

Referring now to FIGS. 2 and 6, the water bed base 20 is shown generally to comprise a bottom external cover 21, a side cover 22, and a top external cover 24, each of which preferably are mutually joined to form an integral external cover. A plurality of elongated flexible positioning strips 23 are disposed on the interior of the water bed base 20. In the illustrated example shown in FIG. 2, there are three flexible positioning strips 23, one disposed in the center and one disposed on each opposite side of the water bed base 20. The three flexible positioning strips 23 in cooperation with the external cover define two container chambers 26 which preferably are slightly larger than the size of the water bed mattresses 10. Attached to the internal surface of each of the flexible positioning strips 23 are a plurality of positioning partition boards 231, each having a ventilation hole 232 defined therethrough. Each of the three flexible positioning strips 23 has an air valve 25 which is used in the inflation process. A preferred location of the air valve 25 is at an internal portion of the flexible partitioning strips 23.

Four container holes 243 are defined on the upper surface of the top external cover 24 at locations respectively proximal to the opposite ends of each container chamber 26. Each container hole 243 is respectively covered by a releasably secured cover member 241. One edge of the cover member 241 preferably is joined to the top external cover 24 at section 242.

A hook and loop fastener, such as that commonly found in the market place under the name VELCRO, preferably is used to fasten and secure the free end of the cover member 241 to the top external cover 24. Thus, when each of the cover members 241 are closed, a uniform external appearance and a functional external seal is provided around the entire water bed base 20.

Referring to FIG. 2, a heater 30 can be incorporated with the water bed base 20. Preferably, the heater 30 is an electric thin plate-type heater disposed on and in thermal contact with the exterior underside of the water bed base 20.

Figure 3:
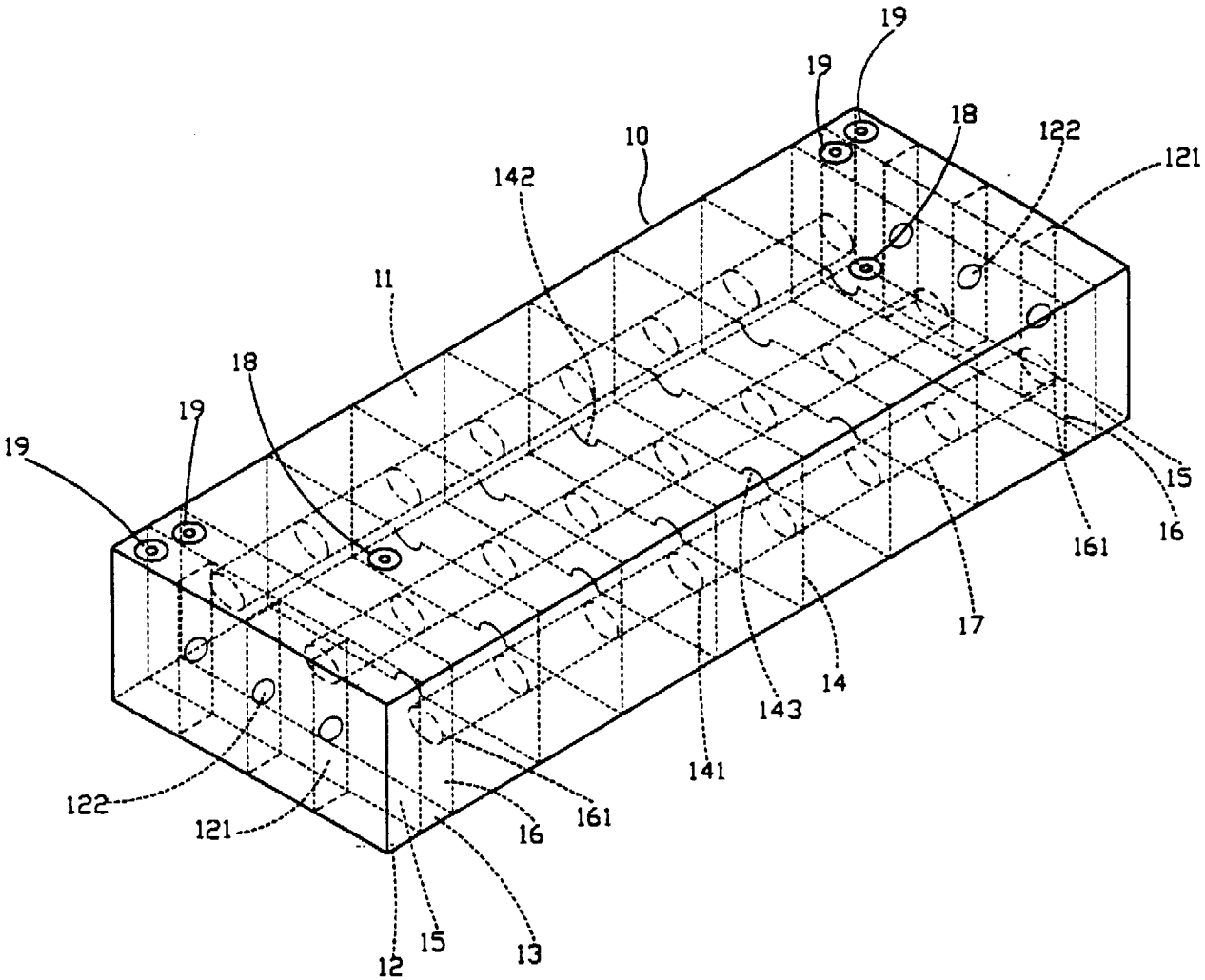
FIG. 3 is a perspective view of a water bed mattress for use in the water bed structure shown in FIGS. 1 and 2.
Figure 4:
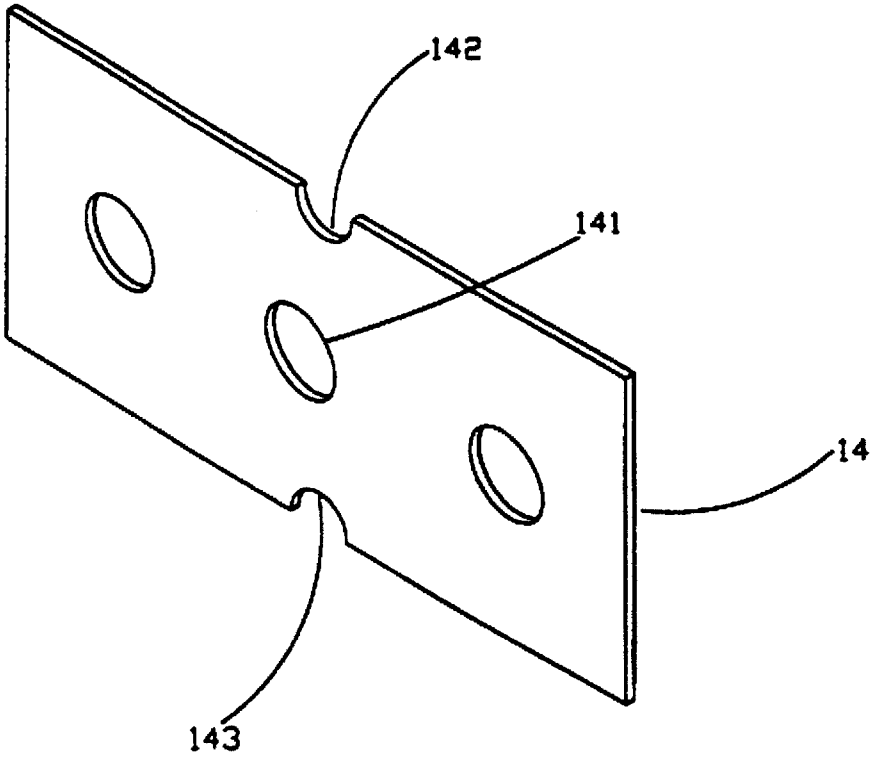
FIG. 4 is a perspective external view of a buffering partition board shown in the water bed mattress of FIG. 3.
Figure 7:
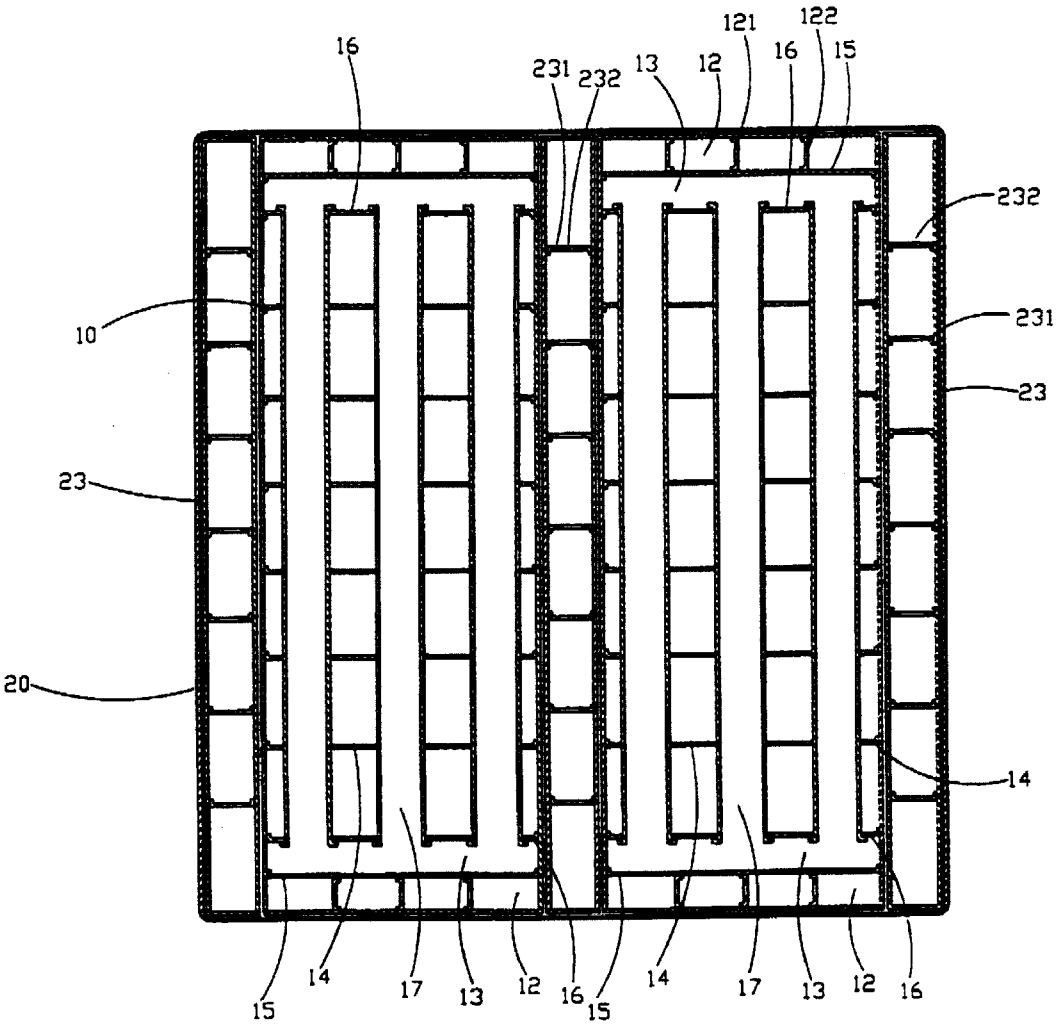
FIG. 7 is a top cross-section view of the water bed base shown in FIG. 6.

With reference now to FIGS. 3, 6 and 7, a mattress 10 is inserted into the water bed base 20 by first opening the cover member 241 of the top external cover 24 of the water bed base 20. Then, a water bed mattress 10, before it is filled with water or air, is inserted into the container chamber 26 through the open container hole 243. The border air chamber 12 and the inflation chamber 13 are then inflated. Preferably, separate air valves 19 on the mattress are used to independently inflate the border air chamber 12 and the inflation chamber 13. From the air introduced to inflate the inflation chamber 13, the elongated air bags 17 in the water bed mattress 10 will inflate as the inflation chamber 13 and the air bags 17 are in fluid communication. As the water bed mattress 10 inflates, it will expand within the container chamber 26 of the water bed base 20. The four container holes 243 defined in the top external cover 24 allow a user to adjust each of the water bed mattresses 10 to a suitable position within the container chamber 26.

A water valve 18 is disposed on the water bed mattress 10 to allow introduction of water into the transverse water chambers 11. The water connecting holes 143 of the buffering partition boards 14 allow the water being introduced through water valve 18 to fill each of the water chambers 11. As the water chambers 11 are being filled, the exhaust hole 142 defined in each of the buffering partition boards 14 allows air to exit the transverse water chambers 11. The water connecting hole 143 also can be used in conjunction with the exhaust hole 142 to alleviate and/or balance the pressure within the transverse water chambers 11. A plurality of pressure relief holes alternatively can be incorporated for this purpose.

As the water chambers 11 are being filled, the volume of air present in the elongated air bags 17 regulates the volume of water received into the transverse water chambers 11. The air bags 17 therefore can be used to either increase or decrease the elastic resistance of the water bed mattress 10 to provide the user with maximum comfort. The air bags 17 also can be used to regulate the water volume to prevent the water bed mattresses from bursting.

The shape of the water bed is prevented from significant deformation after it is inflated with air due to the many restrictions on shape and internal fluid flow. For instance, each of the flexible positioning strips 23 positioned on the center, right and left sides of the water bed base 20 are secured by the plurality of partition boards 231 which maintain the shape of the flexible positioning strips 23. In addition, the border air chambers 12 located at each end of the water bed mattress 10 have the plurality of partition boards 121, each having a ventilation hole 122, to maintain its shape. These restrictions on shape and fluid flow provide the water bed structure of the present invention with the springy effect and firmness of a normal spring mattress. Additionally, the border air chambers 12 and the flexible positioning strips 23 effectively insulate and thereby maintain the temperature of the transverse water chambers 11 of the water bed mattress 10 after heating by the heater 30 (illustrated in FIG. 2).

The plurality of buffering partition boards 14 disposed within the transverse water chamber 11 of the water bed mattress 10 provide the mattress with tension and strength so that the original shape of the water bed mattress 10 is maintained after it is filled with water. Therefore, the transverse water chambers 11 are not likely to be deformed, and thus a smooth, springy and firm water bed mattress 10 is produced. Because of this type of construction, the water bed mattress 10 and water bed base 20 combination achieves the firmness and smoothness of a normal spring bed.

Referring to FIG. 2, if the water bed mattress 10 of the water bed structure according to the present invention develops a leak, the water will only leak into the container chamber 26. Since the bottom of each container chamber 26 defined in the water bed base 20 is completely sealed, it will contain within the water bed base 20 any liquid which leaks out of the water bed mattress 10. Also, if the water bed mattress 10 does in fact develop a leak, it can be easily replaced and the water bed restored to its original condition without replacing the entire water bed structure. This reduces both the cost and effort associated with replacing a leaking water bed having the conventional one piece structure. Also, since the heater 30 of the present invention preferably is located underneath the water bed base 20, it cannot be contacted by any water leaking out of the water bed mattress 10. Thus, water is prevented from directly contacting the electrical circuit used to operate the heater 30, thereby reducing the risk of a potential electrical hazard.

Additionally, because the air bags 17 are disposed within the transverse water chambers 11, when the water bed mattress 10 receives a pressure change, any wave created by such pressure is transmitted to and at least partially absorbed by the transverse water chambers 11 and the air bags 17. The pressure change and associated wave energy in each of the water chambers 11 compresses the air bags 17, thereby simultaneously increasing air density and reducing air volume in the air bags 17. Thus, the air bags 17 effectively dissipate internal pressure of the water bed mattresses 10, which helps to protect against possible bursting. Also, since the air bags 17 absorb the pressure waves caused by an applied load on the bed, new waves are not initiated from the water chambers 11. This design reduces the possibility of damage and also maximizes the stability of the water bed.

Figure 8:
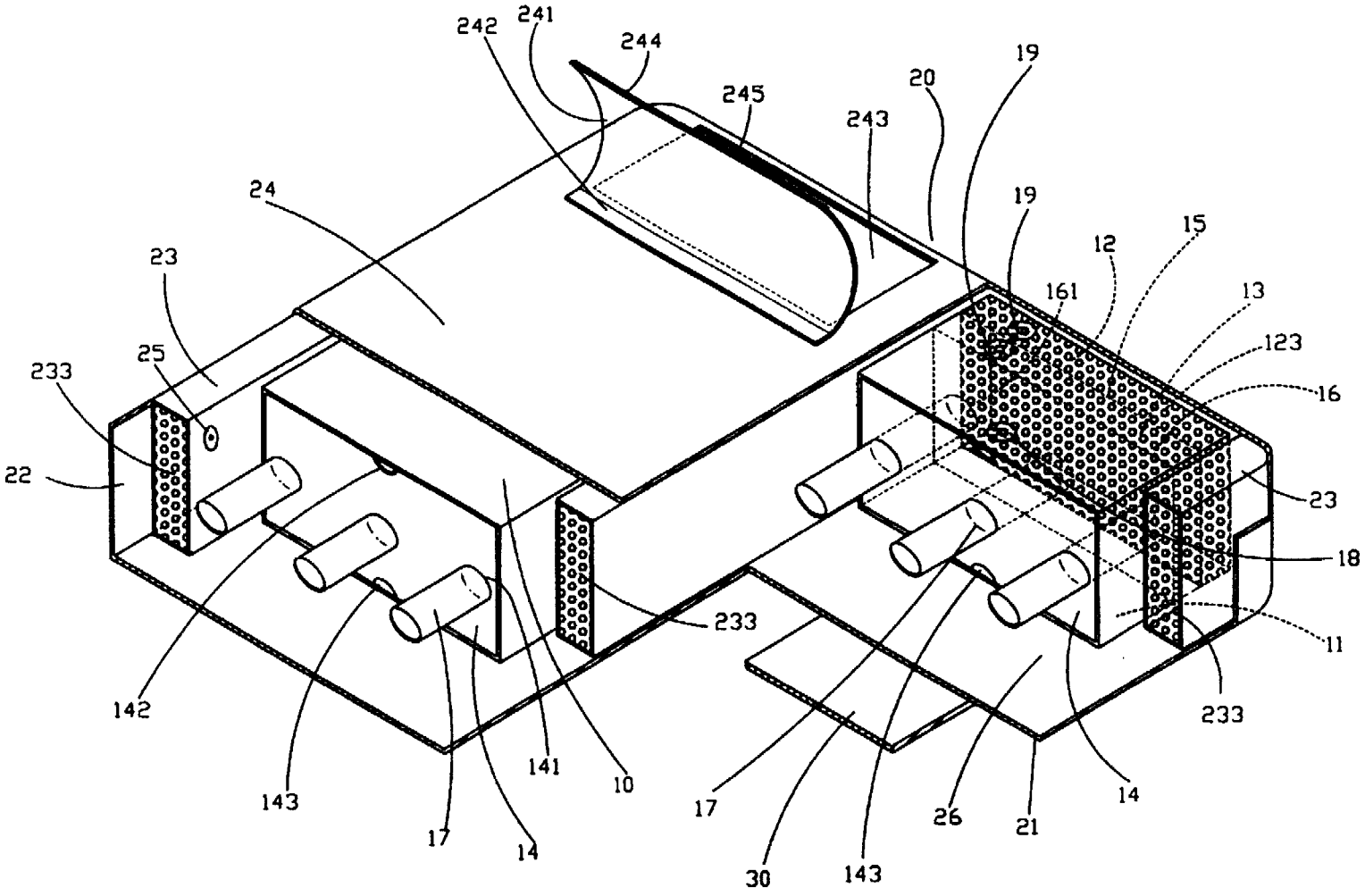
FIG. 8 is a partial perspective cross-section view of a water bed structure according to another embodiment of the present invention.
Figure 9:
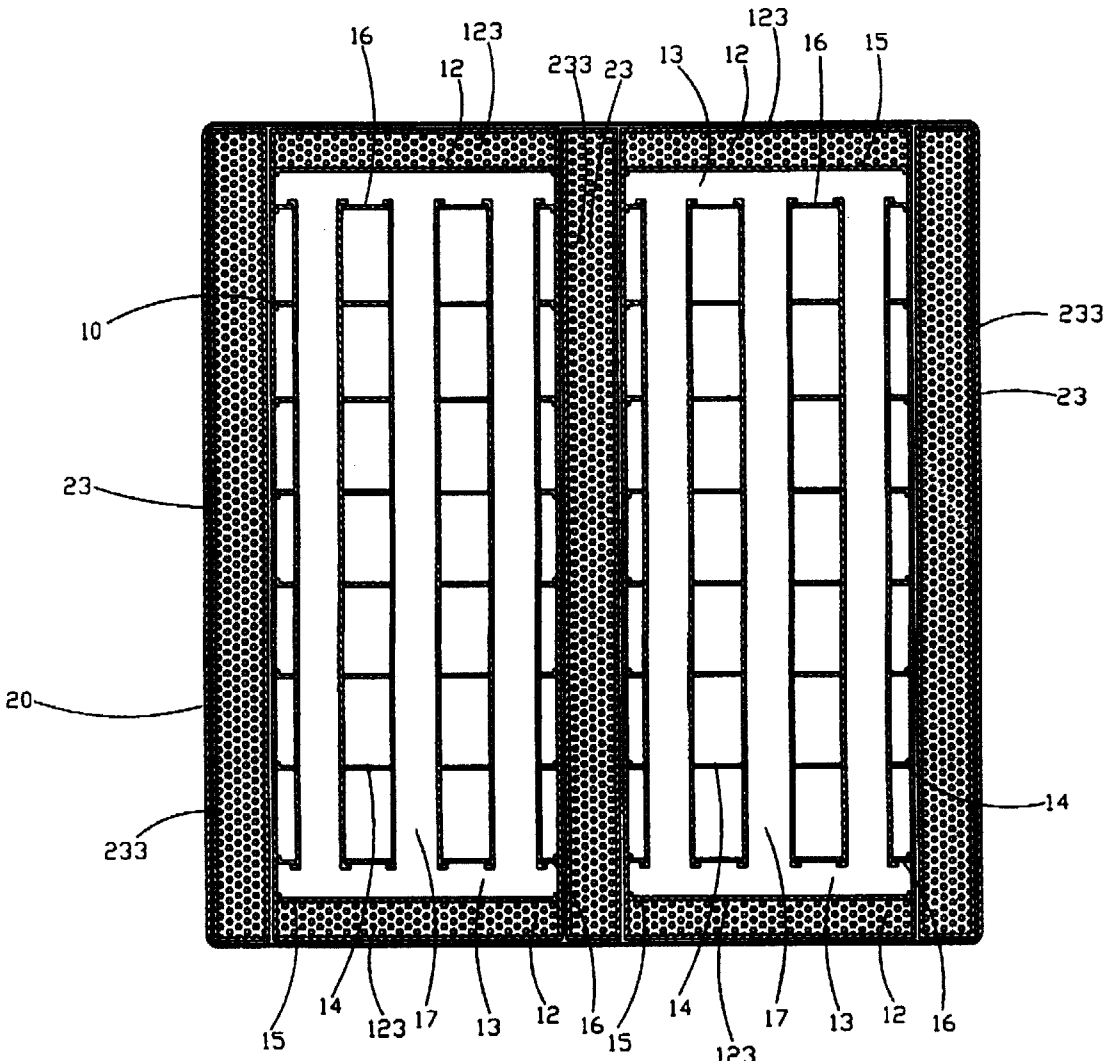
FIG. 9 is a top cross-section view of the embodiment of the present invention shown in FIG. 8.

Referring to FIGS. 8 and 9, a preferred variation of a water bed structure according to the present invention is shown. In this embodiment, the interior of the border air chambers 12 and the flexible positioning strips 23 are filled with a means for maintaining chamber shape, such as a foam or sponge material. In a preferred embodiment, a material comprising mainly polyurethane with smaller quantities of tolylene diisocynate and fire retardant is inserted into the border air chambers 12 and the flexible position strips 23 to maintain their respective shape. Preferably, boards 121/231 used in the embodiment of the water bed illustrated in FIG. 2 are not necessary when means for maintaining chamber shape, i.e., a foam or sponge material, 123/233 is used.

It is to be clearly understood that embodiments disclosed herein merely reflect exemplary embodiments of the present invention, and as such, various modifications and equivalent structures apparent to those skilled in the art can be incorporated therewith without departing from the spirit and the scope of the claims.

I claim:

1. A water bed, comprising a water bed mattress defining an interior chamber, said water bed mattress comprising a plurality of buffering partition boards dividing said interior chamber of said mattress into a plurality of transverse water chambers, each of said buffering partition boards having a plurality of locating holes defined therethrough, a plurality of air bags, each received in one of said locating holes defined through said buffering partition boards, a plurality of sealing partition boards disposed in said interior chamber of said mattress, one of said sealing partition boards and an end of said internal chamber of said mattress defining a border air chamber, a plurality of inflatable partition boards disposed in said internal chamber of said mattress and each having a plurality of inflation holes defined therethrough, one of said inflatable partition boards and one of said sealing partition boards defining an inflation chamber, each of said air bags being in fluid communication with said inflation chamber via said inflation holes, and a plurality of partition boards each having a ventilation hole defined therethrough being disposed in said border air chamber and defining said border air chamber into a plurality of independent border air chambers; and a water bed base, comprising a bottom external cover, a side cover, and a top external cover, said top external cover having a plurality of container holes defined therein, three flexible positioning strips positioned to define sides, of two container chambers in said water bed base, each of said container chambers having an interior volume slightly larger than said mattress, a plurality of positioning partition boards disposed in said flexible positioning strips and each having a ventilation hole defined therethrough, and a plurality of releasably secured cover members positioned on an upper surface of said top external cover, one end of each of said cover members being fixed to said top external cover and another end of each of said cover members being releasably secured to said top external cover such that said cover member removably covers said container holes.

2. The water bed structure as defined by claim 1, further comprising:

a heater provided in thermal contact with said bottom external cover for controlling and adjusting a temperature of said water bed structure.

3. The water bed structure as defined by claim 1, wherein: said border air chamber is filled with a foam material.

4. The water bed structure as claimed in claim 1, wherein:

said flexible positioning strips are filled with a foam material.

5. A water bed structure, comprising:

a water bed base defining a plurality of containing chambers; and at least one water bed mattress removably received in one of said containing chambers of said water bed base, wherein said water bed mattress defines an interior chamber, and said water bed mattress further includes a plurality of partition boards and at least one elongated air bag disposed in said interior chamber, said partition boards defining said interior chamber into a plurality of transverse chambers, said partition boards each having at least one opening defined therethrough and said air bag being received in said opening of at least one of said partition boards.

6. The water bed structure defined by claim 5, wherein:

said water bed mattress further includes a water connecting hole and an exhaust hole, said transverse chambers being in fluid communication via said water connecting and said exhaust holes.

7. The water bed structure defined by claim 6, wherein:

said water bed mattress further includes at least one inflatable partition board having at least one hole defined therethrough disposed in said interior chamber, an end of said air bar being received in said hole.

8. The water bed structure as defined by claim 7, wherein:

said water bed mattress further includes at least one sealing partition board disposed in said interior chamber, said sealing partition board and said inflatable partition board defining an inflation chamber, said inflation chamber and said air bag being in fluid communication via said hole defined through said inflatable partition board, said sealing partition board and an end of said interior chamber of said mattress defining a border air chamber.

9. The water bed structure as defined by claim 8, wherein:

said water bed mattress further includes a plurality of border partition boards each having a ventilation hole defined therethrough disposed in said border air chamber, said border partition boards defining said border air chamber into a plurality of independent border air chambers.

10. The water bed structure as defined by claim 9, wherein:

said water bed base further includes an external cover, said external cover having a plurality of container openings defined therein for removing said water bed mattress from said container chamber.

11. The water bed structure as defined by claim 10, wherein:

said water bed base further includes a plurality of cover members removably covering each of said container openings.

12. The water bed structure as defined by claim 11, wherein:

said water bed base further includes a series of flexible positioning strips disposed in said external cover, said flexible positioning strips defining at least a part of one of said containing chambers of said water bed base.

13. The water bed structure as defined by claim 12, wherein:

said flexible positioning strips further include a plurality of positioning partition boards disposed in an interior thereof.

14. The water bed structure as defined by claim 13, further comprising:

a heater in thermal engagement with an exterior of said external cover of said water bed base for heating said water bed structure.

15. The water bed structure as defined by claim 5, wherein:

said water bed base further includes a series of flexible positioning strips, said flexible positioning strips defining at least a part of one of said containing chambers, said flexible positioning strips of said water bed base having a plurality of positioning partition boards disposed in an interior thereof, an external cover having a plurality of container openings defined therein for removing said water bed mattress from said container chambers, and a plurality of cover members removably covering each of said container openings.

16. A water bed structure, comprising:

a water bed mattress defining an interior chamber and comprising a plurality of partition boards disposed in said interior chamber and defining said interior chamber into a plurality of transverse chambers, each of said partition boards having at least one opening, at least one water connecting hole and at least one exhaust hole defined therethrough, said transverse chambers being in fluid communication via said water connecting and said exhaust holes, at least one elongated air bag received in said opening of each of said partition boards, at least one inflatable partition board disposed in said interior chamber having at least one hole defined therethrough, an end of said air bag being received in said hole, at least one sealing partition board disposed in said interior chamber, said sealing partition board and said inflatable partition board defining an inflation chamber, said inflation chamber and said air bag being in fluid communication via said hole defined through said inflatable partition, and said sealing partition and an end of said interior chamber of said mattress defining a border air chamber, and means for maintaining a shape of said border air chamber disposed in said border air chamber.

17. The water bed structure defined by claim 16, further comprising:

a water bed base defining a plurality of containing chambers, said water bed mattress being removably received in said water bed base.

18. The water bed structure according to claim 17, wherein:

said water bed base further includes a series of flexible positioning strips, said flexible positioning strips defining at least a part of one of said containing chambers, said flexible positioning strips of said water bed base having a means for maintaining a shape of said flexible positioning strips disposed in an interior thereof, an external cover having a plurality of container openings defined therein for removing said water bed mattress from said container chamber, and a plurality of cover members removably covering each of said container openings.

19. The water bed structure defined by claim 18, further comprising:

a heater in thermal engagement with an exterior of said external cover of said water bed base for heating said water bed structure.

* * * * *